United States Patent [19]

Campbell

[11] Patent Number: 4,475,436

[45] Date of Patent: Oct. 9, 1984

[54] MISSILE LAUNCHER

[75] Inventor: Dennis R. Campbell, Lynnwood, Wash.

[73] Assignee: The Boeing Company, Seattle, Wash.

[21] Appl. No.: 141,962

[22] Filed: Apr. 21, 1980

[51] Int. Cl.[3] ..... F41F 3/06

[52] U.S. Cl. ..... 89/1.804; 89/1.815

[58] Field of Search ..... 89/1.801, 1.802, 1.803, 89/1.804, 1.805, 1.815, 1.8, 34, 33 D, 45, 46, 47; 244/137 R

[56] References Cited

U.S. PATENT DOCUMENTS

| | | | |
|---|---|---|---|
| 2,447,941 | 9/1948 | Imber et al. | 89/1.5 H |
| 2,646,786 | 7/1953 | Robertson | 89/1.5 C X |
| 2,826,120 | 3/1958 | Lang et al. | 89/1.803 |
| 2,900,874 | 9/1959 | Tjossem | 89/1.816 |
| 2,988,961 | 6/1961 | Berg | 89/1.801 |
| 3,228,295 | 1/1966 | Kane et al. | 89/1.802 |
| 3,318,042 | 5/1967 | Wolf | 124/48 |
| 4,040,334 | 9/1977 | Smethers, Jr. | 89/1.804 |
| 4,208,949 | 6/1980 | Boilsen | 89/1.801 |

FOREIGN PATENT DOCUMENTS

| | | | |
|---|---|---|---|
| 314993 | 2/1921 | Fed. Rep. of Germany . | |
| 2149954 | 4/1973 | Fed. Rep. of Germany | 89/40 B |
| 82932 | 3/1935 | Sweden . | |
| 579310 | 5/1946 | United Kingdom . | |
| 579560 | 5/1946 | United Kingdom . | |
| 712248 | 7/1954 | United Kingdom . | |

*Primary Examiner*—David H. Brown

*Attorney, Agent, or Firm*—Delbert J. Barnard; Eugene O. Heberer; Joan H. Pauly

[57] ABSTRACT

A rotatable support mounts a plurality of missile carrying missile launchers for rotation about a center axis. Each launcher mounts a plurality of missiles for rotation about an axis. The rotatable support is rotated to successively bring each missile launcher into a launch position. Each such launcher is rotated to successively bring each missile carried by it into a launch position.

17 Claims, 9 Drawing Figures

FIG. 1
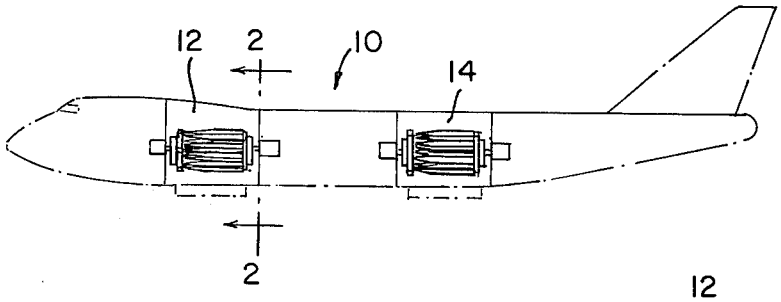
FIG. 2
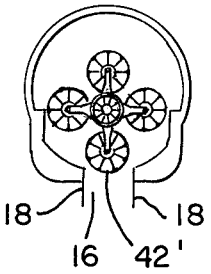
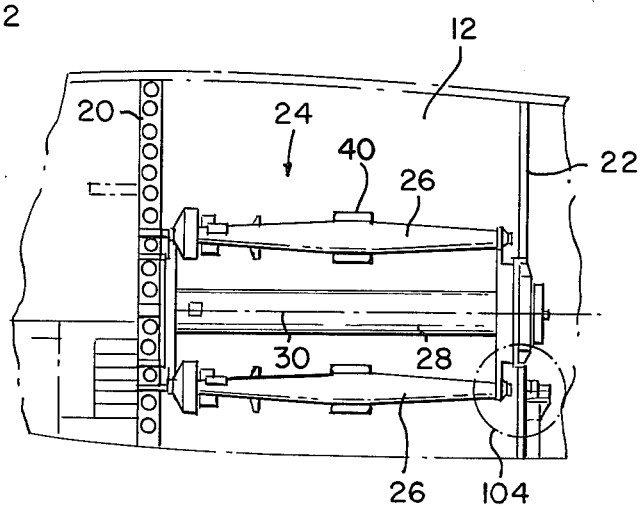
FIG. 3
FIG. 4
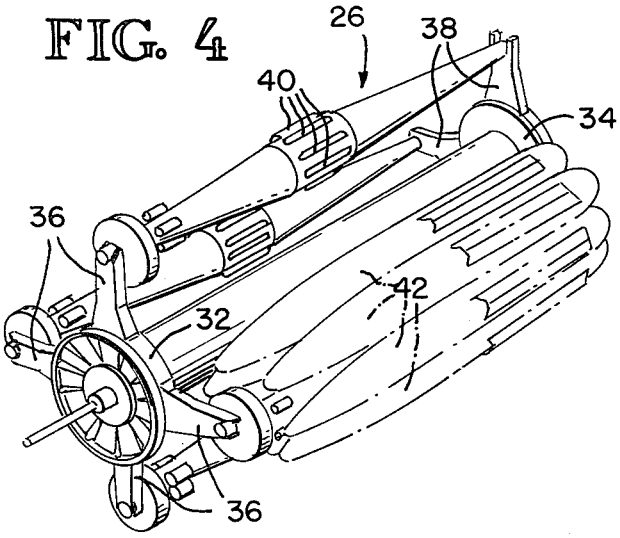
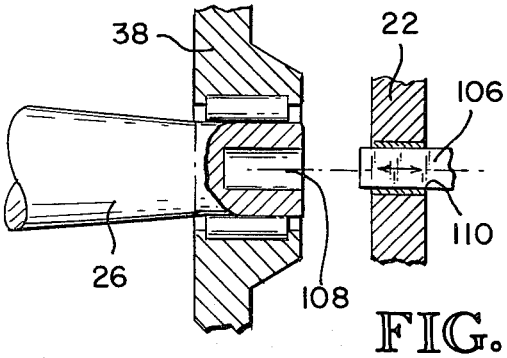
FIG. 5
FIG. 6
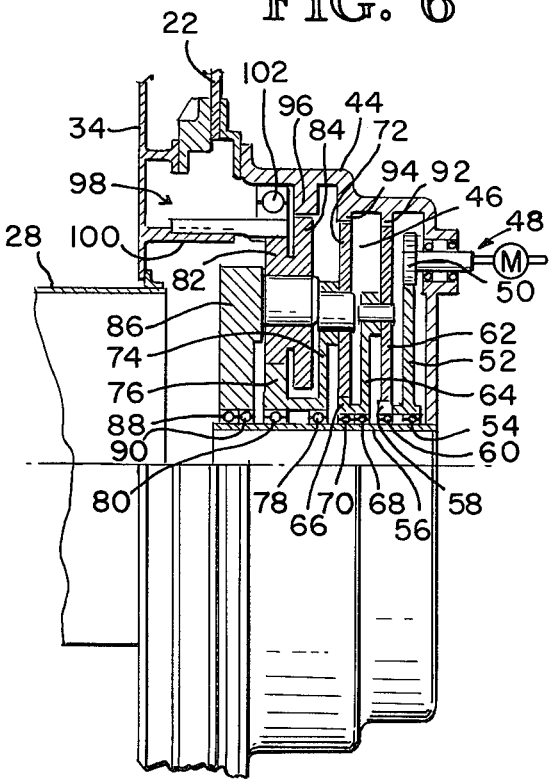

MISSILE LAUNCHER

BACKGROUND OF THE INVENTION

1. Field of the Invention

This invention relates to a missile launching system for a wide body aircraft which is adapted to more fully utilize the payload capacity of the aircraft.

2. Description of the Prior Art

Prior missile launching systems are of three general types: (1) rotary launchers on trolleys which are translated on the main deck of the aircraft to a side eject opening, (2) rotary launchers located within weapons bays under the main deck of the aircraft, and (3) mechanical arms which pick up the missiles from transport rails and successively translate them outside of the aircraft, and then eject them downwardly.

These prior systems are unsatisfactory for several reasons, including: (1) difficult umbilical management, (2) a limitation in the quantity of missiles which they can handle, (3) a slow launch rate, and (4) a low inherent reliability in some cases due to system vulnerability to a single mechanical malfunction.

Rotary type launchers for missiles existing in the patent literature can be found in: U.S. Pat. No. 2,447,941, granted Aug. 24, 1948, to Jack Imber and Hugh Charles Hebard; U.S. Pat. No. 2,646,786, granted July 28, 1953, to Frank H. Robertson; U.S. Pat. No. 2,826,120, granted Mar. 11, 1958, to John M. Lang and Richard T. Graham; U.S. Pat. No. 2,900,874, granted Aug. 25, 1959, to Willard W. Tjossem; U.S. Pat. No. 3,318,042, granted May 9, 1967, to Tobin Wolf; U.S. Pat. No. 3,228,295, granted Jan. 11, 1966, to Garold A. Kane, Harrison Randolph, Robert E. Carlberg, John S. Scheurich, Palmer G. Wermager, Arthur G. Blomquist, Robert L. Kossan and Martin J. Clune; U.S. Pat. No. 4,040,334, granted Aug. 9, 1977, to Rollo G. Smethers, Jr.; British Pat. No. 579,310, granted Aug. 4, 1936, to Boulton Paul Aircraft Limited; British Pat. No. 579,560, granted Aug. 5, 1936, to Boulton Paul Aircraft Limited; British Pat. No. 712,248, granted July 21, 1954, to Saunders-Roe Limited; German Pat. No. 314,993, granted Feb. 18, 1921, to Robert Woerner; and Swedish Pat. No. 82,932, granted Mar. 19, 1955, to L. Orlando.

The foregoing patents should be carefully considered when putting the missile launching system of the present invention into proper perspective relative to the prior art.

SUMMARY OF THE INVENTION

The present invention relates to the provision of a missile launching system which is characterized by a revolving cluster of rotary missile launchers, each of which handles a cluster of missiles.

The missile launching system of the present invention is mountable within a compartment of a wide body aircraft having a launch opening, e.g. a bottom opening, through which the missles are successively launched from the aircraft. The system includes a plurality of rotary missile launchers, each of which supports a plurality of missiles in a cluster spaced about an axis of rotation. The system further includes a rotatable support for the plurality of missile launchers, adapted to support the plurality of launchers in a cluster spaced about the axis of rotation of the support. The system also includes means for rotating the rotatable support so that a particular launcher may be rotated into a launch-ready position relative to the opening in the aircraft, and means for rotating each launcher about its axis of rotation for the purpose of selectively moving the missiles carried thereby into a launch position relative to the opening in the aircraft.

In operation, commencing with one of the missile launchers in the launch-ready position, a missile is launched and then the rotary launcher is rotated to place the next missile in a launch-ready position. This procedure is repeated until all of the missiles of such rotary launcher have been launched. Then, the launcher support is rotated to bring the next cluster of missiles into the launch-ready position. This procedure is repeated until all of missiles have been launched from all launchers, or until the mission has been completed.

This arrangement of a quantity of missiles in a cluster about the axis of rotation of a missile launcher, and the arrangement of a plurality of such launchers in a cluster about the axis of rotation of a rotatable support for the launchers, make possible the handling of a relatively large number of missiles in a wide body aircraft. This is due partially to the fact that the cluster of clusters arrangement makes it possible to store all of the missiles in close juxtaposition with each other and with longitudinal support members of the launcher and the support structure. It is also due in part to the fact that the cluster of missile clusters closely conforms to the cross-sectional shape of the launch compartment in the wide body aircraft.

The missile support structure of this invention is characterized by a plurality of relatively narrow longitudinal support members (the launchers) which are themselves clustered with the missiles, and by a mounting structure for such longitudinal support members which is positioned endwise of the overall cluster of missiles and longitudinal support members.

These and other features, objects and advantages of the present invention will be apparent from the detailed description of the preferred embodiments.

BRIEF DESCRIPTION OF THE DRAWING

FIG. 1 is an elevational view of a wide body aircraft, showing the location of two missile launching systems of the present invention within spaced apart compartments within the body of the aircraft;

FIG. 2 is an enlarged scale cross-section view taken substantially along line 2—2 of FIG. 1, such views showing doors at the bottom of the launching system compartment in an open position;

FIG. 3 is fragmentary longitudinal section view of a launching system compartment portion of the aircraft body, on still a larger scale, showing the missile launching system in side elevation, and omitting the missiles from the launchers;

FIG. 4 is an isometric view of the missile launching equipment, with missiles being omitted from some of the launchers;

FIG. 5 is a fragmentary view of the encircled launcher drive mechanism region of FIG. 3;

FIG. 6 is an axial section view of the rear end portion of the central support tube portion of the rotatable support for the launchers, showing a planetary gearing between an input drive and such tube;

DESCRIPTION OF THE PREFERRED EMBODIMENT

Figure 7:
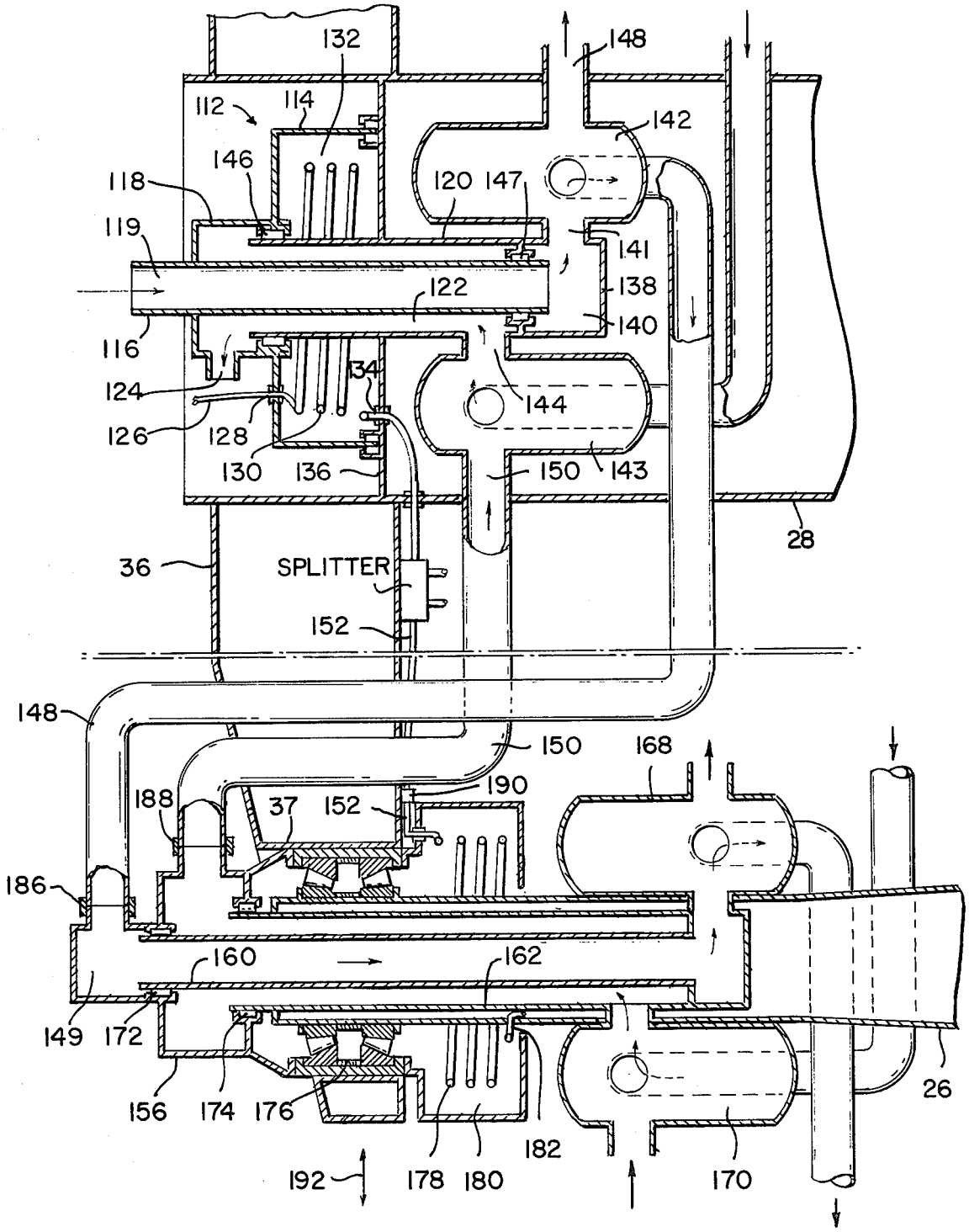
FIG. 7 is a schematic view of the umbilical system.

FIG. 1 depicts a Boeing 747 Cruise Missile carrier aircraft 10 which has been equipped with two missile-launch compartments 12, 14 each having a bottom opening 16 through which the missiles are launched. Openings 16 are provided with doors 18 (FIG. 2).

As best shown by FIG. 3 of the drawing, the forward compartment 12 is closed at its forward end by a pressure bulkhead or end wall 20 and at its after end by a support bulkhead or end wall 22.

The missile launching system shown by FIGS. 1–7 comprises a rotatable support structure 24 for a plurality of missile launchers 26. Each support structure 24 includes an elongated central tubular rotor 28, mounted within its compartment 12 or 14, for rotation about a center axis 30. Bearings carried by the end walls 20, 22 mount the support structure 24 for rotation about the axis 30.

Hub structures 32, 34 positioned at the front and rear ends of central rotor 28 carry a plurality of radial support arms 36, 38 (FIG. 4). Support arms 36, 38 carry bearings at their outer ends which mount the front and rear ends of the tubular missile launchers 26 for rotation about their axes, relative to the support arms 36, 38.

Each missile launcher 26 comprises an elongated tubular rotor having a plurality of missile mounts 40 spaced about its periphery. Each missile mount 40 includes a releasable connector system and an ejector for each missile 42. These details (the connector system and the ejector) are not shown in the drawing since they are well known in the missile launching art.

Wall 22 mounts a gear box 44 which houses a planetary gear mechanism 46 which drivingly connects a motor input shaft 48, connected to a drive motor shown by a graphical symbol in FIG. 6, with the central rotor 28.

As shown by FIG. 6, a small pinion gear 50 at the end of shaft 48 meshes with a large diameter such gear 52 which is mounted for rotation by a bearing 54. Bearing 54 surrounds a stationary stub shaft 56 which is connected to the wall of gear box housing 44. Sun gear 52 is connected to a small diameter sun gear 58. Gear 58 is supported for rotation by a bearing 60. Gear 58 meshes with a plurality of planet gears 62 which are mounted on a carrier 64. Carrier 64 is connected at its center to a small diameter sun gear 66. Carrier 64 and sun gear 66 are supported for rotation on bearings 68, 70. Sun gear 66 meshes with a plurality of planet gears 72 which are carried by a second carrier 74. Carrier 74 is connected to another sun gear 76. Carrier 74 and sun gear 76 are supported for rotation by bearings 78, 80. Sun gear 76 meshes with a plurality of small diameter planet gears 82, each of which constitutes one end of a two gear wheel having a larger diameter second gear 84 at its opposite end. The gears 82, 84 are mounted for rotation on a carrier 86 which is itself mounted for rotation by bearings 88, 90.

The planet gears 62 are driven by sun gear 58. As gears 62 rotate about their individual axes, they also travel along an orbit or internal ring gear 92 which is a fixed part of the inner wall of housing 44. In a like manner, planet gears 72 are driven by sun gear 66. As gears 72 rotate about their individual axes, they also travel along an orbit or ring gear 94 which is fixed to the inner wall of housing 44.

Sun gear 76 drives the small diameter planet gears 82. As gear wheels 82, 84 rotate about their individual axes, the larger gears 84 travel around an internal ring or orbit gear 96 which is fixed to the inner wall of housing 44. The small diameter planet gears 82 also mesh with a ring gear 98 which is secured to the central rotor 28. Gear 98 may be spline connected to a cylindrical extension 100 of hub 34. A bearing 102 may be provided between the wall of housing 44 and the outer surface of geaer 98, in the region immediately surrounding the portion of the internal ring gear 98 which meshes with the planet gears 82.

As will be appreciated, a rotary input by input shaft 48 will be transmitted to the central rotor 28, but at a desired much slower speed of rotation, determined by the design of the planetary gear system that has just been described.

The drive mechanism, which includes input shaft 48, the planetary gearing, and central rotor 28, is operated to rotate the support structure for the missile launchers, for moving the individual missile launchers into a launch position, i.e. into a position of alignment with the lower opening 16 of the launch compartment. This is shown by FIG. 2.

A missile launcher 26 which has been positioned in the launch position may be rotated for the purpose of successively positioning each of the missiles 42 which it carries into a launch position. As used herein, the term "launch position" of a missile means a position in which a missile is adjacent to and in alignment with the launch opening 16. In FIG. 2 missile 42' is shown in its launch position.

According to an aspect of the invention, the missile launchers 26 may be rotated by a drive mechanism 104 which is positioned immediately endwise of the particular launcher 26 which is in the launch position. Mechanism 104 comprises a rotary drive motor, a drive motor support structure, and a drive shaft 106.

As shown by FIG. 5, the rear end of each missile launcher 26 is formed to include a drive member receiving socket 108, or the like. The drive shaft 106 is a motor driven shaft which is sized to be snuggly received within the socket 108. Shaft 106 and socket 108 have complementary noncircular cross sections, so that any rotary drive applied to shaft 106 will be transmitted by it to launcher 26, by way of the side walls of socket 108.

As will be appreciated, shaft 106 is retracted during rotation of the launcher support structure. However, after a missile carrying launcher 26 has been positioned into its launch position, the motor driven drive shaft 106 is extended through an opening 110 in wall 22 into engagement with drive socket 108. The motor-gear box (not shown) is then operated to rotate or index the launcher 26, for successively moving the missiles 42 into the launch position.

By way of typical and therefore nonlimitive example, the embodiment shown by FIGS. 1–7 comprises four missile launchers 26, with each missile launcher carrying eight missiles. The drive mechanism 48, 50, etc. is operated each time to rotate the support structure ninety degrees. Then the launcher drive mechanism 106, 108, etc. is operated to rotate the lower launcher in forty-five degree intervals. That is, after the lowermost missile 42 has been launched, the lower launcher 26 is rotated forty-five degrees to bring the next missile 42 into position for launch. This procedure is repeated six additional times, or until all of the missiles 42 have been launched. Then the support structure is rotated another ninety degrees, for the purpose of bringing the next missile carrying launcher 26 into the launch position.

Figure 9:
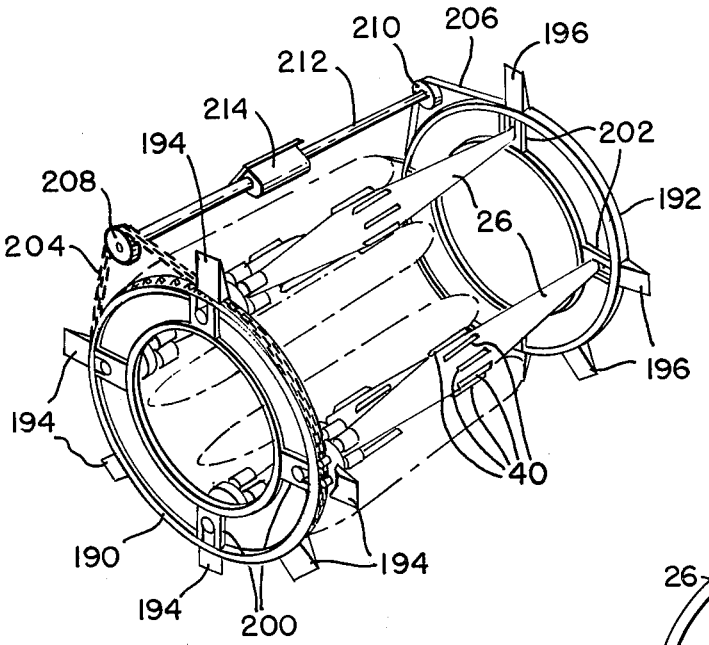
FIG. 9 is a view like FIG. 4, but of the embodiment shown by FIG. 8.
Figure 8:
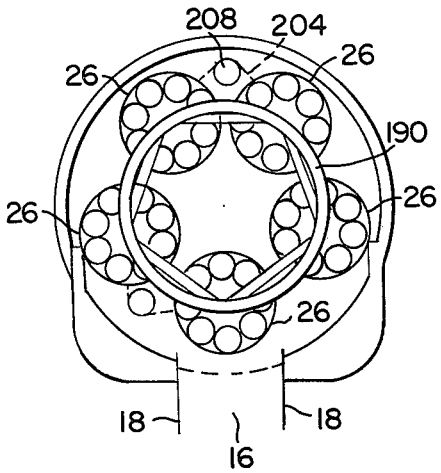
FIG. 8 is a cross sectional view like FIG. 2, but of a modified form of rotatable support mechanism for the plurality of missile launchers.

FIGS. 8 and 9 disclose a second embodiment of the missile launching system of this invention. It is characterized by a missile launcher support structure which comprises a pair of axially spaced apart support rings 190,192. Ring 190 is supported for rotation by a system of bearings 194 which are connected to the forward wall 20. In similar fashion, a plurality of bearings 196, carried by the rear wall 22, mount the rear ring 192 for rotation.

The rings 190,192 carry bearings 200,202 which support the front and rear end portions, respectively. of the missile launcher tubes 26, mounting such tubes 26 for rotation about their individual axes.

The two rings 190,192 must be driven in unison, so that the launcher tubes 26 remain in correct alignment. This may be done by use of a chain and gear drive. Each support ring 190,192 may be constructed to include a plurality of radially outwardly directed gear teeth which mesh with teeth receiving spaces in a drive chain 204,206. Chains 204,206 may also mesh with the teeth of a pair of small diameter drive gears 208,210, secured to the opposite ends of a drive shaft 212. As ilustrated, drive shaft 212 may be driven by a drive motor 214. Of course, a chain and gear drive is quite well known. For that reason, neither the gear members nor the chains have been fully detailed in the drawing. The gear teeth carried by the rings 190, 192 may be inset within the peripheries of the rings 190, 192.

In operation, the drive motor 214 is operated for rotating the two support rings 190, 192, in unison, for successively positioning the individual missile launchers 26 into the missile launch position. The same mechanism that is used in the first embodiment for rotating the individual missile launchers, for successively moving the missiles 42 into the launch position, may be used with this embodiment for performing this same function.

FIG. 7 illustrates a typical umbilical management system. Wall 20 mounts a fixed structure 112 which comprises a fixed housing 114, a first tube 116, and a second tube 118. Tube 116 provides an inlet passageway 119 for air. An annular second passageway is defined around tube 116, radially between it and fixed tube 118 and a rotatable third tube 120. This passageway 122 carries return air to a discharge outlet 124. The electrical wiring 126 which extends to points of connection with the electronic mechanism within the missile launchers 26 extends through an opening 128 into the housing 112 and is formed into a coil 130 within an annular chamber 132 which is defined about tube 120, radially between it and the sidewall of housing 114. The bundle of wires 126 then extends through an opening 134 in a radial wall 136 which is secured to tube 120.

Wall means 138 defines a first chamber 140 which is in air receiving communication with passageway 119. Chamber 140 communicates via a tube 141 with a supply manifold 142. A return manifold 143 is connected to passageway 122 via a tube 144. Rotating to non-rotating seal-bearing units, 146, 147 are provided between the rotating parts and the stationary tubes 116, 118.

Manifold 142 includes a radially outwardly directed outlet passageway 148 for each missile launcher 26 and manifold 143 includes a radially inwardly directed inlet passageway 150 for each missile launcher 26. Each pair of air delivery passageways 148, 150 extends radially through or along the support arm 36 for its launcher 26. Passageways 148, 150 may be totally or partially formed by flexible hoses.

On the inner side of wall 136 the bundle of wires 126 divides into four parts, one part 152 for each launcher 26. Each such part 152 extends radially outwardly within the support arm 36 for its launcher 26. As should be apparent, rotation of central rotor 28 in one direction results in an uncoiling of coil 130. Rotation in the opposite direction results in a recoiling of the coil 130. The coil 130 is of sufficient length to permit a full 360° rotation of rotor 28.

The structure contained within the hub region of rotor 28, providing a non-rotating to rotating connection, is essentially duplicated at the outer end of each support arm 36. Each support arm 36 presents a mounting slot 37 at its outer end. Each slot receives a bearing block 176. A bearing block 176 is located at each end of each launcher 26. As shown by FIG. 7, the tubular end portion of the launcher 26 extends through the bearing 176. The inner race of the bearing 176 is secured to the tube and the outer race is within an outer housing which is received within slot 37. A rotatable center tube 160, and a surrounding larger diameter second tube 162, extend endwise outwardly from launcher tube 26. An air inlet manifold 168 and an air outlet manifold 170 are carried by the launcher body. Tubes 160, 162 are mounted for rotation by bearing-seal units 172, 174. The electrical wire 152 is formed into a coil 178 within a chamber 180 and the launcher end of such coil 178 extends through a side wall opening 182 in the launcher 26 into the interior of the launcher 26, to connect with electronic devices carried by the launcher 26. As before, the coil 178 is uncoiled during one direction of rotation of the missile launcher 26 and is recoiled during reverse rotation.

Conduits lead air from manifold 168 into the launcher and additional conduits return the air from the launcher into manifold 170.

According to an aspect of the invention, the launchers 26 are transported to the aircraft with the missiles on them. Each loaded launcher is then moved through the compartment opening and secured to its pair of mounting arms 36,38. The bearing boxes 176 are positioned within the slots 37 at the ends of the arms 36 and are then secured to the arms in any suitable manner. Quick connect-disconnect couplings 186, 188 are provided for connecting the air hoses 148, 150 to the swivels 149, 156. Also, quick connect-disconnect electrical coupling 190 is provided to connect together the portion of wire 152 which is carried by the launcher 26 with the portion that is carried by the arm 36.

The hook-up structure into the individual missiles 42, the ejectors 40, and the detachable connections between the launcher 26 and the missiles 42 are all standard equipment and form no part of this invention. The ejectors 40 may be the well known MAU/12BAC type ejectors.

The above described mechanisms at the hub of central rotor 28 and at the outer end of each arm 36, for providing a non-rotating to rotating transition of air supply and return lines and the electrical wiring, are per se not a part of this invention. However, the cluster arrangement of clusters of missiles which basically characterizes my invention makes it possible to use such structure at both locations and greatly simplifies the umbilical management. In other words, the cluster arrangement of clusters of missiles makes it possible to service a large number of missiles in a relatively simple way, by a relatively simple umbilical management system.

The invention may be embodied in other specific forms without departing from the spirit of central characteristics of the invention. The embodiments which are illustrated and described are to be considered in all respects as illustrative and not restrictive. The scope of the invention is to be determined from the appended claims rather than from the foregoing description, and all structures which come within the meaning and range of equivalency of the claims are to be embraced by the claims.

I claim:

1. A missile launching system mountable within an aircraft provided with an opening through which missiles are launched from said aircraft, comprising:

a plurality of rotary missile launchers, each comprising means for supporting a plurality of missiles in a cluster spaced about the axis of rotation of the rotary missile launcher;

a rotatable support means for said plurality of missile launchers, mounted for rotation about an axis, and including means supporting said plurality of launchers in a cluster spaced about the axis of rotation of said support means;

means for rotating said rotatable support means so that a particular launcher may be rotated into a launch-ready position relative to the opening in the aircraft; and means for rotating each said launcher about its axis of rotation for the purpose of selectively moving missiles carried thereby into a launch position relative to the opening in the aircraft.

2. A missile launching system according to claim 1, wherein each rotary missile launcher comprises an elongated tubular rotor, and the rotatable support means comprises bearing means at each end of the rotor, mounting it for rotation about its axis of rotation, relative to the rotatable support means.

3. A missile launching system according to claim 1, wherein each rotary missile launcher comprises an elongated tubular rotor, and said means for supporting a plurality of missiles comprises a plurality of missile mounts that are spaced circumferentially about said rotor.

4. A missile launching system according to claim 1, wherein said rotatable support means comprises an elongated center tube, a hub structure at each end of said tube, and a plurality of support arms extending radially outwardly from said hub structures, said support arms carrying bearing means at their outer ends which mount the rotary missile launchers for rotation relative to said arms.

5. A missile launching system according to claim 1, wherein said rotatable support means comprises a pair of axially spaced apart support rings, said support rings carrying bearings which engage end portions of the rotary missile launchers, mounting them for rotation about their axes, relative to the support rings, and drive means for rotating the support rings in unison about the axis of rotation of said support means.

6. A missile launching system according to claim 1, wherein the means for rotating each missile launcher about its axis of rotation comprises a drive mechanism positioned endwise of the particular missile launcher which is in the launch-ready position, said drive mechanism including drive couple means which is moveable into driving engagement with the launch-ready missile launcher, for rotating it to move the missiles carried by it into the launch position, and is retractable out of driving engagement with such missile launcher, so that it will not interfere with rotation of the rotatable support means, for moving another missile launcher into the launch-ready position.

7. In an aircraft fuselage, a missile compartment comprising axially spaced apart end walls extending transversely of the fuselage to define a missile compartment, and with the fuselage including an opening through which missiles are loaded into and launched out from the compartment, and a missile launching system within said compartment, comprising:

a plurality of rotary missile launchers, each comprising means for supporting a plurality of missiles in a cluster spaced about the axis of rotation of the rotary missile launcher;

a rotatable support means for said plurality of missile launchers, mounted for rotation about an axis, and including means supporting said plurality of launchers in a cluster spaced about the axis of rotation of said support means;

means for rotating said rotatable support means so that a particular launcher may be rotated into a launch-ready position relative to said opening in the fuselage; and means for rotating each said launcher about its axis of rotation for the purpose of selectively moving missiles carried thereby into a launch position relative to said opening in the fuselage.

8. A missile launching system according to claim 7, wherein each rotary missile launcher comprises an elongated tubular rotor, and the rotatable support means comprises bearing means at each end of the rotor, mounting it for rotation about its axis of rotation, relative to the rotatable support means.

9. A missile launching system according to claim 7, wherein each rotary missile launcher comprises an elongated tubular rotor, and said means for supporting a plurality of missiles comprises a plurality of missile mounts that are spaced circumferentially about said rotor.

10. A missile launching system according to claim 7, wherein the means for rotating each missile launcher about its axis of rotation comprises a drive mechanism positioned endwise of the particular missile launcher which is in the launch-ready position, said drive mechanism including drive couple means which is moveable into driving engagement with the launch-ready missile launcher, for rotating it to move the missiles carried by it into the launch position, and is retractable out of driving engagement with such missile launcher, so that it will not interfere with rotation of the rotatable support means, for moving another missile launcher into the launch-ready position.

11. Apparatus according to claim 7, wherein said rotatable support means comprises a tubular shaft, a hub structure at each end of the shaft, means carried by said end walls mounting said hub structures for rotation relative to the fuselage, and support arms extending radially outwardly from said hub structures, including bearing means at their outer ends which engage the opposite ends of the missile launchers, mounting such missile launchers for rotation relative to the rotatable support means.

12. Apparatus according to claim 11, wherein the means for rotating said rotatable support means comprises a gear box carried by one of said end walls, endwise outwardly of the near end of said tubular shaft, speed reducing gear means within said gear box, having an output connected to said tubular shaft and an input shaft, and drive means connectable to said input shaft.

13. Apparatus according to claim 7, wherein said rotatable support means comprises a pair of axially spaced apart support rings at the front and rear ends of the missile compartment, and bearing means carried by the end walls of the compartment mounting said support rings for rotation, said support rings carrying bearings which engage end portions of the rotary missile launchers, mounting said launchers for rotation relative to the support rings, and wherein the means for rotating said rotatable support means comprises drive system means for rotating said support rings in unison.

14. Apparatus according to claim 13, wherein said drive system means comprises an elongated fore-and-aft extending drive shaft having a sprocket at each of its ends, sprocket teeth extending around the periphery of each support ring, a drive chain for each support ring, engaging the sprocket teeth on such ring and engaging the sprocket at its end of the compartment, and drive means for rotating said drive shaft.

15. A missile launching system according to claim 13, wherein each rotary missile launcher comprises an elongated tubular rotor, and the rotatable support means comprises bearing means at each end of the rotor, mounting it for rotation about its axis of rotation, relative to the rotatable support means.

16. A missile launching system according to claim 13, wherein each rotary missile launcher comprises an elongated tubular rotor, and said means for supporting a plurality of missiles comprises a plurality of missile mounts that are spaced circumferentially about said rotor.

17. A missile launching system according to claim 13, wherein the means for rotating each missile launcher about its axis of rotation comprises a drive mechanism positioned endwise of the particular missile launcher which is in the launch-ready position, said drive mechanism including drive couple means which is moveable into driving engagement with the launch-ready missile launcher, for rotating it to move the missiles carried by it into the launch position, and is retractable out of driving engagement with such missile launcher, so that it will not interfere with rotation of the rotatable support means, for moving another missile launcher into the launch-ready position.

* * * * *